US005513446A

United States Patent [19]

Neubauer et al.

[11] Patent Number: 5,513,446

[45] Date of Patent: May 7, 1996

[54] METHOD AND APPARATUS FOR DRYING INDUSTRIAL BARRELS

[75] Inventors: Wilhelm Neubauer, Wien; Peter Hauschka, Bisamberg, both of Austria

[73] Assignee: Aichelin GmbH, Germany

[21] Appl. No.: 232,286

[22] PCT Filed: Sep. 4, 1993

[86] PCT No.: PCT/EP93/02394

§ 371 Date: Oct. 7, 1994

§ 102(e) Date: Oct. 7, 1994

[87] PCT Pub. No.: WO94/05961

PCT Pub. Date: Mar. 17, 1994

[30] Foreign Application Priority Data

Sep. 7, 1992 [DE] Germany ..... 42 30 066.5

[51] Int. Cl.[6] ..... F26B 5/14

[52] U.S. Cl. ..... 34/397; 34/437; 34/104; 34/105

[58] Field of Search ..... 34/92, 186, 104, 34/105, 551, 284, 287, 289, 296, 397, 413, 437, 439, 440; 437/57, 92; 165/87

[56] References Cited

U.S. PATENT DOCUMENTS

| | | | |
|---|---|---|---|
| 282,814 | 8/1883 | Weidmann | 34/104 |
| 1,461,148 | 7/1923 | Hughes | 34/92 |
| 1,719,331 | 7/1929 | Kemp | 34/105 |
| 2,049,812 | 8/1936 | Loacker | 34/104 |
| 2,084,460 | 6/1937 | Snow | 34/105 |
| 2,140,841 | 12/1938 | Leonard et al. | 34/105 |
| 5,050,315 | 9/1991 | Reznik | 34/60 |

FOREIGN PATENT DOCUMENTS

| | | |
|---|---|---|
| 0218733 | 4/1987 | European Pat. Off. . |
| 979120 | 11/1948 | France . |
| 168548 | 3/1906 | Germany . |
| 1035574 | 7/1958 | Germany . |
| 423530 | 9/1974 | U.S.S.R. . |

*Primary Examiner*—James C. Yeung
*Attorney, Agent, or Firm*—Kokjer, Kircher, Bowman & Johnson

[57] ABSTRACT

A method and an apparatus serve for drying industrial barrels (60). The industrial barrels (60) are positioned on an inclined base (12, 20) and are enclosed by a pressure-tight vacuum hood (30). A suction pipe (40) that is connected with the vacuum hood (30) extends through a bunghole (63) provided in the tilted barrel (60) at its lowest point (71) where the residual liquid quantity (70) gathers. A heating rod (55) is arranged inside the suction pipe (40). The suction pipe (40) is connected to a vacuum pump (48). The heated suction pipe (40) removes from the interior of the barrel (60) at first die liquid residual liquid quantity (70), and then the vaporizing residual liquid. Compared with conventional methods, using hot steam for drying, this method leads to cost savings and an improved drying effect (FIG. 1 ).

20 Claims, 2 Drawing Sheets

METHOD AND APPARATUS FOR DRYING INDUSTRIAL BARRELS

BACKGROUND OF THE INVENTION

The present invention relates to a method for drying hollow bodies having an access opening, especially for drying industrial barrels after washing, where the hollow body is tilted and a residual liquid quantity that is still contained in the hollow body and that has gathered at a lowest point of the hollow body is removed from the hollow body by means of a suction pipe introduced through the access opening.

The invention further relates to an apparatus for drying hollow bodies having an access opening and being positioned on an inclined support, especially for drying industrial barrels after washing, having holding means for the hollow bodies and a suction pipe as well as a displacing device for introducing the suction pipe into the access opening in such a way that the end of the suction pipe comes to lie at the lowest point within the hollow body.

A method and an apparatus of the before-mentioned type is known from SU-PS-423 530.

Given the general shortage of raw materials, it is of general interest, with respect to the use of hollow bodies, to enable even such hollow bodies, which formerly would be used only once, i.e. as a single-used packing, to be used repeatedly, i.e. as a multiple-use packing.

Whenever the term "hollow bodies" is used in the context of this application, this term is to be interpreted as referring to industrially employed containers by means of which liquids or pourable solid materials are transported. For reasons of greater simplicity and better illustration, the following specification will refer to the example of industrial barrels, without however thereby limiting the scope of the present invention.

Industrial barrels are produced and in use in different sizes and different designs. One typical industrial barrel is a steel-sheet drum having a diameter of approximately 560 mm and a height of approximately 900 mm, corresponding to a volume of approximately 220 liters. Barrels of this type are used for transporting the most different goods, including for example organic liquids, such as oils, varnishes, fuels, and the like.

Such industrial barrels are already in use as multiple-use packings, which requires however that the barrels be reconditioned after every use. According to the known reconditioning methods for such barrels, one proceeds for example as follows: First of all, any residual content is removed from the barrels. Then the barrel inside is washed, for example using a soda lye, and then rinsed. The barrel edges are then mechanically dressed, and dents are removed from the barrel bodies, for example by blowing in compressed air. Thereafter, one removes old external paint finishes, if any, and cleans the barrel from rust. Finally, a new paint finish is applied, the barrels are checked for tightness, rinsed once more with water, and are then dried.

It is of course desirable that upon completion of these procedural steps, the barrel inside should be dry, if possible. This is necessary on the one hand in order to prevent further corrosion of the barrels; on the other hand, however, it must be ensured that no residual liquid or residual water remains in the barrel as such residual quantities could possibly react with the medium to be filled in later.

According to the known methods, final drying of the barrels was effected by heating them directly with a gas flame, or by drying them with hot air, hot steam and compressed-air. In a practical example, for drying a barrel of the described type, 5 Kg of steam at a pressure of 12 bar are needed for example, in which case a circulating-air temperature of 180° C. can be reached via a heat exchanger. For pre-heating the barrels, 0.05 Kg of fuel oil and a total of approximately 0.2 KW of electric power are consumed per barrel for the circulating-air fans and the blow-out devices.

In drying barrels of this type, it has further been known to heat compressed-air via heat exchangers and to blow the heated air into the barrels, but this process that does without recirculated air leads to an even higher energy consumption.

All these known methods have in common that they require not only a high energy input for drying a barrel, but that in addition it cannot be excluded, for none of the before-mentioned methods, that the barrel still contains a residual quantity of humidity, in particular a residual water quantity, especially when hot steam is used for drying and when the residual heat of the barrels is to be utilized for final drying.

SU-PS-423 530 describes a barrel-washing machine by means of which the barrels are washed and then dried in a position in which the barrels are tilted. Any residual liquid left in the barrels is drawn off at the lowest point of the inner space of the barrels by means of a suction pipe. In the case of the known machine, this is done in an upside down position, which means that the barrels are mounted on the suction pipe with the access opening in downward position. A thin tube, which is then swung out laterally from the suction pipe, reaches down to the lowest point of the hollow interior of the barrel.

The known machine does not have any means for seating the barrels. Although the known machine comprises a pipe section suited for extracting air and steam from the machine, this pipe section only has the function of a chimney because the machine is freely accessible from the side. This is so because big openings can be seen in the sidewalls of the machine, with a frame extending through these openings for introducing barrels into, and removing them from, the interior of the machine. These openings are suitably sized to permit the machine to be loaded from one side and to be discharged on the opposite side.

Thus, the known machine offers the disadvantage that "drying" is possible, if at all, only insofar as the liquid flows off the barrel spontaneously, through the access opening pointing to the bottom, or is extracted by means of the suction pipe that has been introduced from below and has been swung out laterally. Beyond this, a drying action is neither envisaged, nor possible.

DE-OS 23 55 910 describes another method for drying containers. According to this known method, a probe designed in the form of a flame thrower is introduced into the container, and a fuel gas, such as butane, propane of natural gas, is guided through the probe and ignited so that the container inside is dried by the resulting flame.

It is understood that, therefore, this known method can be used only for certain specific containers that will not change inadmissibly by the direct contact with the flame. In addition, the generation and handling of flames as part of an industrial production process is problematic also under safety aspects.

SUMMARY OF THE INVENTION

It is the object of the present invention to improve a method and an apparatus of the before-mentioned type so that hollow bodies, especially industrial barrels, can be dried with a substantially lower consumption of energy, while at the same time the residual quantity of humidity in the barrel is further reduced and a defined adjustment of the dew point is rendered possible.

According to the invention, this object is achieved, with the before-mentioned method, by the steps of:

a) Positioning the hollow body in a vacuum space, with the access opening pointing to the top;

b) evacuating the hollow body to a predetermined negative pressure level by means of the suction pipe that has been introduced into the hollow body from above;

c) heating simultaneously the suction pipe;

d) re-ventilating the hollow body at the end of a predetermined period of time.

With the before-mentioned apparatus, the object underlying the invention is achieved by:

a) A vacuum chamber on which the suction pipe is fixed, the suction pipe being displaceable, by means of the displacing device, in downward direction into a first position in which the suction pipe is introduced into the access opening from above, and in upward direction into a second position in which it is completely withdrawn from the hollow body;

b) a vacuum pump for generating a vacuum in the hollow body; and c) heating means for the suction pipe.

The object underlying the present invention is thus perfectly achieved.

For, the suction pipe initially acts, in the conventional manner, to extract the full residual liquid quantity from the tilted hollow body, leaving only a small residue and the water drops that adhere to the barrel wall. The water quantity extracted from the hollow body is not vaporized during this process, which means that no heat is initially extracted from the wall or the bottom of the hollow body. In the further course of the drawing-off or evacuating process, the pressure drops below the saturation steam pressure of the remaining residual water, and the walls of the hollow body dry up completely. In this way, approximately two thirds of the residual water quantity are directly transported into the vacuum pump, which means that no vaporizing energy has to be consumed for this water quantity. Only one third of the residual water quantity is then vaporized by the heated suction pipe, which results in a heating power consumption of only 0.5 KW for usual barrels. The vaporized residual water quantity is then drawn off as water vapor by the vacuum pump. The simultaneous action of heating the suction pipe and evacuating also results in reduced condensation.

The residual heat of the hollow body is generally utilized for vaporizing the residual water inside the barrel. The suction pipe is heated in order to prevent its cooling down, since during the suction operation water drops are also taken in, which then vaporize inside, thereby extracting heat from the suction pipe. If an unheated suction pipe were used, condensate would drip back into the barrel after the evacuation process. The suction pipe is also heated in order to introduce additional heat into the hollow body. Normally, the barrels are internally dried immediately after the washing or painting operation—so, the barrel already presents a certain temperature in most of the cases. The vacuum drying process enables most of the accumulated heat of the barrel to be utilized. If necessary, any lacking quantity of heat is contributed, either in full or in part, by the suction pipe heating, especially when the barrel is too cold.

By evacuating the barrel to a given vacuum level, and by the re-gassing step it is possible to adjust the residual water vapor content and, thus, the dew point of the air in the hollow body after the drying process to a predetermined value.

According to a preferred embodiment of the method according to the invention, a vacuum hood is placed on the hollow body.

According to a corresponding further improvement of the apparatus according to the invention, the suction pipe is fixed on a vacuum hood which, in the first position, encloses the hollow body positioned on the support in a pressure-tight manner while in the second position the hollow body is fully released.

These features provide the advantage that no sealing arrangements have to be made on the hollow body itself, because the complete hollow body is located inside the vacuum hood.

Further, it is regarded as a particular advantage that during the evacuating process the suction pipe provides for a scavenging effect via the access opening of the hollow body, the scavenging quantity corresponding to the difference in volume between the volume of the hollow body and that of the vacuum hood. One thereby achieves an adjustable scavenging effect by means of dry air, outside the hollow body, depending on the particular difference in volumes. As a rule, a scavenging effect in the range of approximately 50 to 100% is sought. The scavenging effect serves to further dry the air in the hollow body, as a result of which fact the dew point of the air in the hollow body is further lowered. The scavenging effect of the suction pipe further acts to remove the water vapor caused by the vaporization of the drops that adhere to the inner wall of the hollow body. This further reduces the evacuating times and the residual humidity remaining in the hollow body. It is an additional advantage in this connection that during re-ventilation via the suction pipe, the larger volume of the vacuum hood gives rise to the same scavenging effect as during the evacuation phase, but now in reverse direction. This reduces the remaining residual humidity still further.

According to a further development of the before-mentioned embodiments of the invention, a vacuum hood is placed on a plurality of hollow bodies, as part of the method according to the invention, and in a further development of the apparatus according to the invention, the vacuum hood encloses a plurality of hollow bodies in the first position.

This feature provides the advantage that a plurality of hollow bodies can be dried simultaneously during a single motion sequence of the vacuum hood.

According to another variant of the invention, the hollow bodies are moved through a vacuum tunnel during the method according to the invention, and suction pipes are provided in that area of the vacuum tunnel which is passed by the hollow body.

This feature provides the advantage to allow continuous drying of a plurality of hollow bodies.

According to another preferred embodiment of the method according to the invention, the residual liquid quantity is drawn off by means of a vacuum pump.

This feature provides the advantage that only a single pump is used for simultaneously drawing off the residual liquid quantity and adjusting the vacuum.

According to a practical example of the invention, the ratio of volumes of the vacuum space or the vacuum hood on the one hand and the hollow body on the other hand is between 1.5 and 2.0.

It is further preferred if dry air, preferably dried compressed-air, is used for re-ventilation.

This feature offers the advantage that it is thereby rendered possible, in the described manner, to adjust the residual water vapor content and, thus, the dew point of the air in the hollow body after the drying process to a predetermined value. If, for example, the hollow bodies are evacuated to 12 mbar and dry air having a dew point of +2° C. at 8 bar is used for reventilation, the dew point of the air in the barrel will adjust itself to −5° C. in the described example of an industrial barrel. If the process is performed at a final negative pressure of 22 to 25 mbar, then the dew point of the air in the barrel will be situated at maximally +5° C.

An especially good effect is achieved when the suction pipe comprises a valve for re-ventilation.

This feature offers the advantage, that has already been mentioned, that a scavenging effect via the suction pipe also occurs during re-ventilation.

It is further preferred if the tilted support is inclined relative to the horizontal line at an angle of between 5° and 20°, preferably 15°.

This feature provides the advantage that on the one hand the residual liquid quantity can reliably collect at the lowest point of the hollow body while on the other hand, in the case of hollow-cylindrical hollow bodies, especially industrial barrels, the suction pipe can be introduced optimally through the bunghole.

Finally, another embodiment of the invention is preferred where the vacuum pump is a water ring pump.

This feature offers the advantage that liquid can be drawn off, too, by means of the vacuum pump, without a need for a separate condenser.

Other advantages will become apparent from the following description and the attached drawing.

It is understood that the features mentioned above and those yet to be explained below can be utilized not only in the respective combinations indicated, but also in other combinations or in isolation, without leaving the context of the present invention.

Some examples of the invention will now be described in more detail, with reference to the drawing in which:

DETAILED DESCRIPTION OF THE PREFERRED EMBODIMENTS

Figure 1:
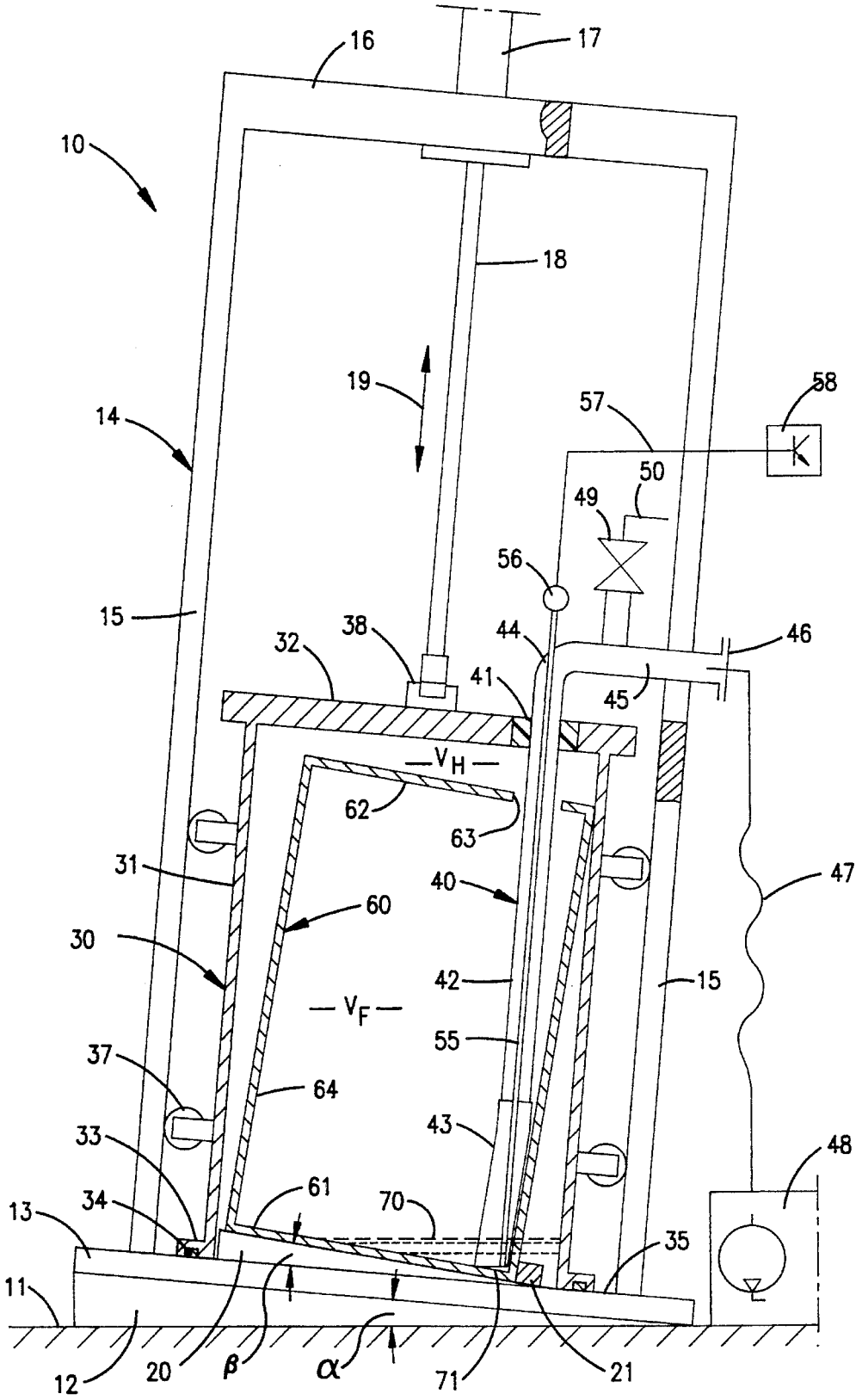
FIG. 1 shows a—partly sectional—side view of one embodiment of a barrel-drying apparatus according to the invention, suited for carrying out the method according to the invention.

In FIG. 1, an apparatus for drying industrial barrels of the before-mentioned type is indicated generally by reference numeral 10.

The apparatus 10 rests entirely on a foundation 11. Mounted on the foundation 11 is a first wedge-type base 12 forming with the horizontal line an angle α of, for example, approximately 10°.

On the first wedge-type base 12, a metallic bottom plate 13 can be seen. Arranged on the bottom plate 13 is a frame rack 14. The frame rack 14 consists substantially of lateral frame pieces 15, whose lower ends are connected with the bottom plate 13 by screws, and upper frame pieces 16 closing the frame rack 14 on top, at the upper ends of the lateral frame pieces 15.

Fixed to the upper frame pieces 16 is a lifting cylinder 17 whose lifting rod 18 can be displaced in a direction parallel to the lateral frame pieces 15, as indicated by arrow 19.

A second wedge-like base 20, located above the bottom plate 13, within the frame rack 14, is inclined relative to the bottom plate 13 by an angle β of, for example, 4.2°. The bases 12, 20 are inclined in the same direction so that the angles of inclination α and β add up, and the surface of the second wedge-like base 20 is altogether inclined by, for example, approximately 15° relative to the horizontal line.

At the right-hand lower end of the second wedge-like base 20—as viewed in FIG. 1—there may be provided a stop 21.

In the operating condition illustrated in FIG. 1, a vacuum hood 30, with its opening pointing downward, is placed on the bottom plate 13. The vacuum hood 30 comprises a hollow-cylindrical wall 31 closed on its top by a cover plate 32. At the lower end of the hollow-cylindrical wall 31, the latter terminates by an annular bottom flange 33. The bottom flange 33 is provided with a seal 34, indicated only diagrammatically, which is in tight contact with the surface 35 of the bottom plate 13. The inner space of the vacuum hood 30, having a volume VH is thus closed against the outside in pressure-tight relationship.

The hollow-cylindrical wall 31 of the vacuum hood 30 is equipped with rollers 37 that run on the lateral frame pieces 15, or on guides held by the latter. The lifting rod 18 being pivotally mounted by its lower end on a bracket 38 of the cover plate 32 of the vacuum hood 30, it is possible to move the complete vacuum hood 30 up and down in the direction of arrow 19. In the position depicted in the Figure, the vacuum hood 30 occupies its lower position in which—as mentioned before—the interior of the vacuum hood 30 is closed pressure-tight. In contrast, in its upper position—not illustrated in FIG. 1—the vacuum hood 30 has been moved upward far enough to make the entire space that is enclosed by it in the illustrated position freely accessible. Therefore, the frame piece 14 is more than twice as high as the vacuum hood 30.

Rigidly mounted on the cover plate 32 of the vacuum hood 30, by means of a seal 41, is a suction pipe 40. The suction pipe 40 comprises a vertical pipe 42, known as "lance". The lower end of the pipe 42 terminates, preferably, by a flexible hose end 43. The upper end of the vertical pipe 42 is provided with an elbow 44, followed by a horizontal pipe end 45. The free end of the pipe end 45 carries a connection flange 46. A line 47 can be connected to the flange 46. The flexible line 47 leads to a stationary vacuum pump 48. It is, however, understood that the vacuum pump may also be rigidly connected with the vacuum hood 30, in which case a rigid connection may be installed between the flange 46 and the vacuum pump 48.

The pipe end 45 further comprises a branching connecting to a ventilation valve 49. The outlet end of the ventilation valve 49 is connected to a line 50 through which dry air can be supplied.

Inside the suction pipe 40, there is further arranged a vertical heating rod 55. The heating rod 55 extends over the whole length of the vertical pipe 42 and the hose end 43 and through the upper end of the elbow 44, where the heating rod 55 terminates by an electric connection 56. A line 57 leads from the connection 56 to a power supply 58, indicated only schematically.

According to a variant of the invention (not illustrated), the heating rod 55 may be heated also by means of other media (for example steam, hot water, etc.). In any such case, the heating rod would conveniently consist of a pipe with closed lower end and a linear lance extending along the pipe. If an annular gap is provided between the pipe and the lance, the heating medium (steam, hot water, etc.) can then be introduced through the inner lance, and returned toward the top by the annular gap, along the outer pipe.

Inside the vacuum hood 30, one can see a barrel 60 whose bottom face 61 rests on the second wedge-like base 20 and which is held in a reference position by a stop 21, visible at the right bottom in FIG. 1. A standardized bunghole 63 is arranged in the upper face 62 of the barrel 60. The hollow-cylindrical wall of the barrel 60 is indicated by reference numeral 46.

Given the fact that the barrel 60 is inclined relative to the horizontal line by approximately 15°, its inner space, whose volume is indicated in FIG. 1 by VF, has a lowest point 71, adjacent the stop 21, where any residual liquid quantity 70 present (depicted out of scale) will gather. In the case of the described industrial barrel, this quantity 70 may be equal, for example, to 0.1–0.3 liters.

The apparatus 10 removes the residual liquid quantity 70 from the barrel 60 and, at the same time, dries the barrel 60 as efficiently as possible. In order to achieve these objectives, the apparatus works as follows.

At the beginning of the drying process, the lifting cylinder 17 has pulled the lifting rod 18 into its upper position, and the vacuum hood 30 occupies its upper end position—not shown in FIG. 1—in which the second wedge-like base is freely accessible. The flexible line 47 may be flexible enough to bridge the travel of the vacuum hood 30; or else the flexible line 47 may be separated from the vacuum hood 30 in its raised position, for later being re-connected to the vacuum hood 30 in its lowered condition. When the vacuum pump 48 moves together with the vacuum hood 30, then the flexible line 47 may also be replaced by a rigid line, as mentioned before.

Now, with the apparatus 10 in this initial position, a barrel 60 to be dried is placed on the second wedge-like base 20. This may be done either manually or with the aid of known automatic handling mechanism. It is further understood that a plurality of apparatuses 10 may be arranged on a common chassis, in the fashion of a carousel, in order to load the barrels successively into, or unload them from, the apparatuses 10, in which case the entire drying process may be performed, for example, during one cycle of such a carousel.

After the barrel 60 has been placed on the second wedge-like base 20, the lifting cylinder 17 lowers the lifting rod 18 so as to move the vacuum hood 30 into its lower end position, as indicated in FIG. 1. The arrangement is such that when the vacuum hood 30 moves in a downward direction, the suction pipe 40, which is rigidly connected with the vacuum hood 30, is introduced into the bunghole 63 since the barrel has been placed on the second wedge-like base 20 at a reference position. The length of the suction pipe 40 is selected to ensure that the suction pipe 40 will reach down to the lowest point 71. Tolerances, if any, are compensated by the hose end 43, which is also in a position to adapt itself obliquely to the inclined wall 64 in the lower area of the barrel 60.

Next, the vacuum pump 48 is switched on so that the interior of the barrel 60 is slowly evacuated.

The vacuum pump 48 may be a water ring pump with attached gas radiator, and as such it will be possible without any problems to draw off the residual liquid quantity 70 directly by the vacuum pump 48, and also to establish thereafter a substantial negative pressure in the barrel 60 and/or the vacuum hood 30. To this end, the vacuum pump 48 may have a rated output of, for example, 50 to 90 m3/hr.

Simultaneously with switching on the vacuum pump 48, the heating rod 55 is rendered active, for example via the power supply 58 mentioned before, so that the heating rod 55 is heated up, for example at the before-mentioned heating power of approximately 0.5 KW.

Since the air is drawn off via the suction pipe 40, the air present in the vacuum hood 30 outside the barrel 60 will flow into the barrel through the bunghole 63 and will then also be drawn off. Since the air present outside the barrel is dry air, this action results in a scavenging effect by which the wet air present in the barrel 60 is gradually replaced by the dry air. The volume ration VH/VF of interest in this case lies, for example, between 1.5 and 2.0.

During the suction process, the residual liquid quantity 70 will of course be drawn off at first in liquid form, so that only the suction power, not the vaporizing power, will be required in this phase. With the barrel 60 tilted as described, the residual liquid quantity 70 amounts to approximately two thirds of the total residual liquid quantity in the barrel 60, which would be in the range of one eighth to one quarter of a liter with conventional washing methods.

Meanwhile, the heating rod 55 heats up the suction pipe 40 to generate the vaporizing heat which includes the heat of the heating rod and the heat accumulated by the barrel. The vaporizing heat is required for vaporizing and drawing off the rest of the liquid present in the barrel 60 not gathered at the bottom at the point indicated by 70.

The drawing-off process takes some time, and the adjusted final negative pressure of, for example, 22 to 25 mbar may, preferably, be maintained for some time, for example for some minutes.

At the end of this period of time, or when the adjusted final negative pressure has been reached, the vacuum pump 48 is switched off, and the valve 49 is opened. This permits dry air to flow in via the line 50 and the suction pipe 40 and into the interior of the barrel 60. As the dry air emerges from the lower end of the hose end 43 of the suction pipe 40, any residual air still present in the barrel 60, that is still at the final negative pressure, will partly escape through the bunghole 63 and into the interior of the vacuum hood 30 outside the barrel 60. This reverse scavenging effect acts to further remove humidity from the inside of the barrel 60.

Once the atmospheric pressure has built up again inside the vacuum hood 30, the vacuum hood 30 is returned to its upper initial position by means of the lifting cylinder 16. The barrel 60 is now dry and can be removed from the second wedge-like base 20.

Figure 2:
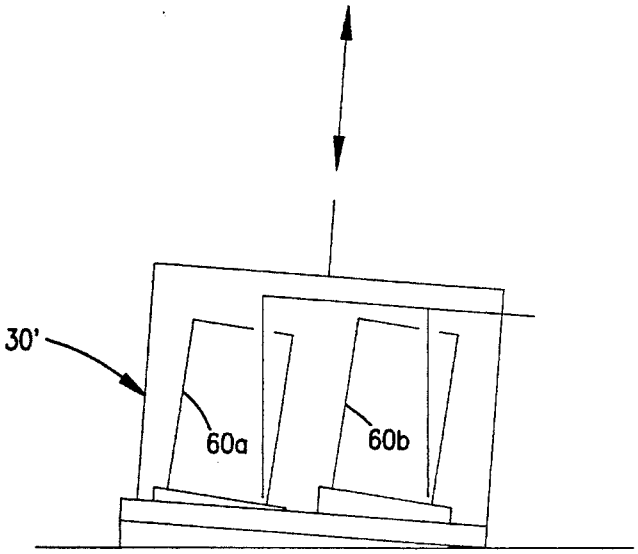
FIG. 2 shows a variant of the embodiment illustrated in FIG. 1, comprising a vacuum hood covering a plurality of hollow bodies.

FIG. 2 shows, in diagram form, a variant of the apparatus according to FIG. 1. This variant differs from the apparatus according to FIG. 1 by the fact that the embodiment according to FIG. 2 makes use of a vacuum hood 30' covering simultaneously two barrels **60*a* and 60*b*. The twin vacuum hood 30' is placed on, and removed from, the two barrels 60*a*, 60*b* simultaneously. The suction pipe is designed in this case as a twin suction pipe which is introduced into the barrels 60*a*, 60*b***, and then removed from them at the end of the drying process in a single operation.

Figure 3:
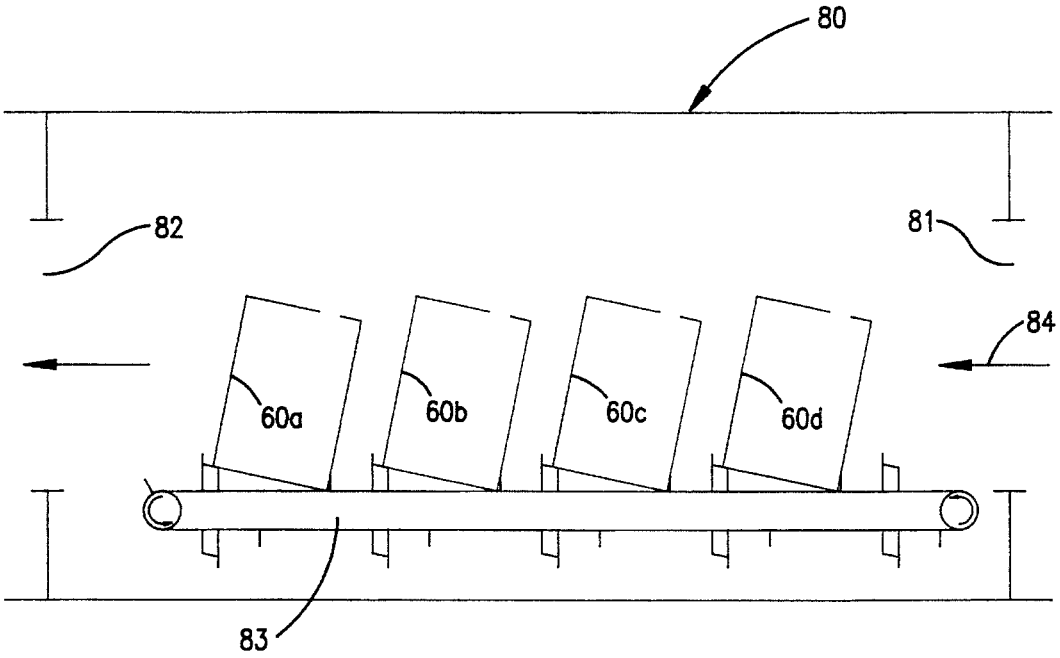
FIG. 3 shows another variant of the invention, where the hollow bodies to be dried are run through a vacuum tunnel.

FIG. 3 finally shows another variant of the invention where a plurality of barrels **60*a* to 60*d* are run through a vacuum tunnel 80. The vacuum tunnel 80 comprises an inlet gate 81 and an outlet gate 82. A suitable conveyor belt 83, with holders that maintain the barrels 60*a* to 60*d* in a tilted position, continuously transports the barrels 60*a* to 60*b* through the vacuum tunnel 80, as indicated by arrows 84**.

In the case of the embodiment according to FIG. 3, different types of suction pipes may be used, for example travelling suction pipes that are introduced into a barrel at the beginning of the conveyor belt 83, and are removed from the barrel at the end of the conveyor belt 83. When passing through the vacuum tunnel 80, the suction pipes may be connected, for example, in the known manner to a conventional slotted suction channel.

In one practical example of the invention according to FIG. 1, the following amounts of energy and material were consumed for drying a barrel 60;

For the drive motor of the vacuum pump 80 and for heating the heating rod 55, a total of 0.185 KWh of electric energy were required. For the re-ventilation process, 0.5 Kg of re-gassing air at 20° C. and with a dew point of +2° C. at 8 bar were used. The quantity of cooling water needed for the vacuum pump 48 amounted to 25 liters at 15° C.

In contrast, the energy and material consumption of conventional barrel drying processes using hot steam at 180° C. for heating and vaporizing the residual liquid quantity requires approximately 5 Kg of hot steam at 180° C. at 12 bar for drying one barrel 60. The scavenging air required for removing the residual steam amounts to eight to nine times the barrel volume, which means that approximately 1.7 m3 of scavenging air at 20° C., with a dew point of +2° C. at 8 bar, are consumed.

Based on the present price level the foregoing amounts means that the costs caused by the method according to the invention amount to only 8% of the costs of conventional drying processes.

It should be stressed once more at this point that the described example of drying barrels is not meant to restrict the scope of application of the invention. Instead, the invention may be applied to other vessels, for example cans, containers, or the like, that are used industrially for similar or other purposes.

We claim:

1. A method for drying hollow bodies having an access opening, the method comprising the steps of:

providing a suction pipe adapted to be introduced into said access opening;

positioning said hollow body in a vacuum chamber with said access opening pointing upwardly;

tilting said hollow body for allowing a residual quantity of liquid within said hollow body to be collected at a lowermost point of said hollow body;

introducing said suction pipe into said hollow body through said access opening until a lower terminal end of said suction pipe is at said lowermost point;

evacuating said hollow body to a predetermined vacuum pressure level by means of said suction pipe;

simultaneously heating said suction pipe; and re-ventilating said hollow body at the end of a predetermined period of time.

2. The method of claim 1, further comprising: placing a vacuum hood above said hollow body.

3. The method of claim 1, further comprising: placing a vacuum hood above a plurality of hollow bodies.

4. The method of claim 1, further comprising: running said hollow bodies through a vacuum tunnel.

5. The method of claim 1, further comprising: sucking said residual quantity of liquid off by means of a vacuum pump.

6. The method of claim 1, wherein the volume ratio between said vacuum chamber and said hollow body is between 1.5 and 2.0.

7. The method of claim 1, further comprising: adjusting said vacuum pressure level to a value below the saturation pressure of water between 10 mbar and 25 mbar.

8. The method of claim 1, wherein dry air is used for re-ventilation.

9. The method of claim 1, wherein said hollow bodies include industrial barrels which are vacuum dried after washing.

10. The method of claim 1, wherein dried compressed air is used for re-ventilation.

11. An apparatus for drying hollow bodies having an access opening, comprising:

an inclined support having holding means for tilting and holding said hollow bodies with said access opening pointing upwardly, wherein a residual quantity of liquid within said hollow body collects at a lowermost point of said hollow body when tilted;

a vacuum chamber, moveable between a first position proximate to said inclined support and a second position remote from said inclined support;

a suction pipe affixed to said vacuum chamber and adapted to be introduced into said access opening;

displacement means secured to said vacuum chamber for moving said vacuum chamber in a vertical direction between said first and second positions, said displacement means moving said vacuum chamber in a downward direction to said first position at which said vacuum chamber encloses said hollow body in a pressure-tight manner and at which said suction pipe is received within said access opening with a lower terminal end of said suction pipe being located at said lowermost point, said displacement means moving said vacuum chamber in an upward direction to said second position at which said suction pipe is completely withdrawn from said hollow body;

a vacuum pipe communicating with said vacuum chamber for generating a vacuum in said hollow body; and heating means communicating with said suction pipe for heating said suction pipe.

12. The apparatus of claim 11, wherein said vacuum chamber includes a vacuum hood to which said suction pipe is fixed, while in said first position, said hood enclosing said hollow body positioned on said support in a pressure-tight manner, while in said second position, said hood fully releasing said hollow body.

13. The apparatus of claim 12, wherein said vacuum hood encloses a plurality of hollow bodies when in said first position.

14. The apparatus of claim 11, wherein a plurality of suction pipes are provided in a vacuum tunnel through which said hollow bodies are passed.

15. The apparatus of claim 11, wherein a volume ratio between said vacuum chamber end said hollow body is between 1.5 and 2.0.

16. The apparatus of claim 11, wherein said suction pipe comprises a valve for re-ventilation.

17. The apparatus of claim 11, wherein said inclined support has an inclination angle ($\alpha+\beta$) of between 5° and 20°.

18. The apparatus of claim 17, wherein said inclination angle ($\alpha+\beta$) is 14°.

19. The apparatus of claim 11, wherein said vacuum pump is a water ring pump.

20. The apparatus of claim 11, wherein said hollow bodies include industrial barrels which are vacuum dried.

* * * * *